US005344676A

United States Patent [19]

Kim et al.

[11] Patent Number: 5,344,676

[45] Date of Patent: Sep. 6, 1994

[54] METHOD AND APPARATUS FOR PRODUCING NANODROPS AND NANOPARTICLES AND THIN FILM DEPOSITS THEREFROM

[75] Inventors: Kyekyoon Kim; Choon K. Ryu, both of Urbana, Ill.

[73] Assignee: The Board of Trustees of the University of Illinois, Urbana, Ill.

[21] Appl. No.: 965,351

[22] Filed: Oct. 23, 1992

[51] Int. Cl.[5] ..... B05D 1/04; B05B 5/035

[52] U.S. Cl. ..... 427/468; 427/483; 264/10; 118/621; 118/624; 361/228

[58] Field of Search ..... 427/468, 469, 483; 118/621, 623, 624, 627; 239/3, 690; 264/10; 361/228

[56] References Cited

U.S. PATENT DOCUMENTS

| | | | |
|---|---|---|---|
| 4,264,641 | 4/1981 | Mahoney et al. | 427/483 |
| 4,476,515 | 10/1984 | Coffee | 361/226 |
| 4,549,243 | 10/1985 | Owen et al. | 361/228 |
| 4,574,092 | 3/1986 | Gourdine | 427/483 |
| 4,748,043 | 5/1988 | Seaver et al. | 427/483 |
| 4,762,553 | 8/1988 | Savage et al. | 264/10 |
| 4,762,975 | 8/1988 | Mahoney et al. | 427/472 |
| 4,929,400 | 5/1990 | Rembaum et al. | 264/10 |

FOREIGN PATENT DOCUMENTS

| | | | |
|---|---|---|---|
| 568466 | 11/1977 | U.S.S.R. | 427/483 |

OTHER PUBLICATIONS

Woosley, J. et al., "Field injection electrostatic spraying of liquid hydrogen," J. Appl. Phys., vol. 64, No. 9 (Nov. 1988) pp. 4278–4284.

Kim, K. et al., "Generation of charged drops of insulating liquids by electrostatic spraying," J. Appl. Phys., vol. 47, No. 5 (May 1976) pp. 1964–1969.

Woosley, J. et al., "Electrostatic Spraying of Insulating Liquids: $H_2$", IEEE Trans. Ind. Appl., vol. IA-18, No. 3 (May/Jun. 1982) pp. 314–320.

*Primary Examiner*—Terry J. Owens

*Attorney, Agent, or Firm*—Roger M. Fitz-Gerald

[57] ABSTRACT

A method and apparatus for producing nanodrops which are liquid drops with diameters less than one micron and producing therefrom solid nanoparticles and uniform and patterned film deposits. A liquid precursor is placed in an open ended tube within which is a solid electrically conductive needle which protrudes beyond the open end of the tube. Surface tension of the liquid at the tube end prevents the liquid from flowing from the tube. Mutually repulsive electric charges are injected into the liquid through the needle, causing the surface tension to be overcome to produce a plurality of liquid jets which break up into nanodrops.

18 Claims, 3 Drawing Sheets

METHOD AND APPARATUS FOR PRODUCING NANODROPS AND NANOPARTICLES AND THIN FILM DEPOSITS THEREFROM

BRIEF SUMMARY OF THE INVENTION

The present invention relates to a method and apparatus for producing nanodrops, liquid drops with diameters less than one micron, and producing therefrom both nanoparticles, solid particles with diameters less than one micron, and improved uniform and patterned thin film deposits.

BACKGROUND OF THE INVENTION

Electrostatic spraying is a process in which a liquid surface is charged by an applied voltage. When the electrical forces exceed the surface tension, the surface is disrupted to produce liquid jets or drops of liquid. Co-inventor Kim, with R.J. Turnbull, studied this phenomenon, as reported in 47 Journal of Applied Physics 1964–1969 (1976). That paper discussed the previous formation of single jets of liquids having high conductivity and the spraying at a slow rate of large drops of an insulator. The paper itself reported the spraying of a jet of FREON, an insulator, which broke up into drops, all larger than ten (10) microns in diameter.

Further research by co-inventor Kim with R. J. Turnbull and J.P. Woosley was reported in IEEE Transactions on Industry Applications, Vol. IA-18, No. 3 pp. 314–320 (1982) and 64 Journal of Applied Physics 4278–4284 (1988). These papers reported the electrostatic spraying of another insulator, liquid hydrogen. The smallest drops observed were larger than nine (9) microns in diameter.

None of the research described above produced nanodrops, or used the nanodrops to produce nanoparticles or either uniform or patterned thin film deposits.

It appears to the present inventors that this deficiency was the result of the fact that only a single charged jet was produced, which caused the drops resulting from jet breakup to be of a relatively large size compared to nanodrops.

U.S. Pat. No. 4,993,361 to Unvala on superficial examination might appear to be material to the present invention. However, Unvala merely atomizes and ionizes a liquid, then heats it to produce a vapor. The size of the drops which are produced is not disclosed.

DETAILED DESCRIPTION OF THE INVENTION

Figure 1:
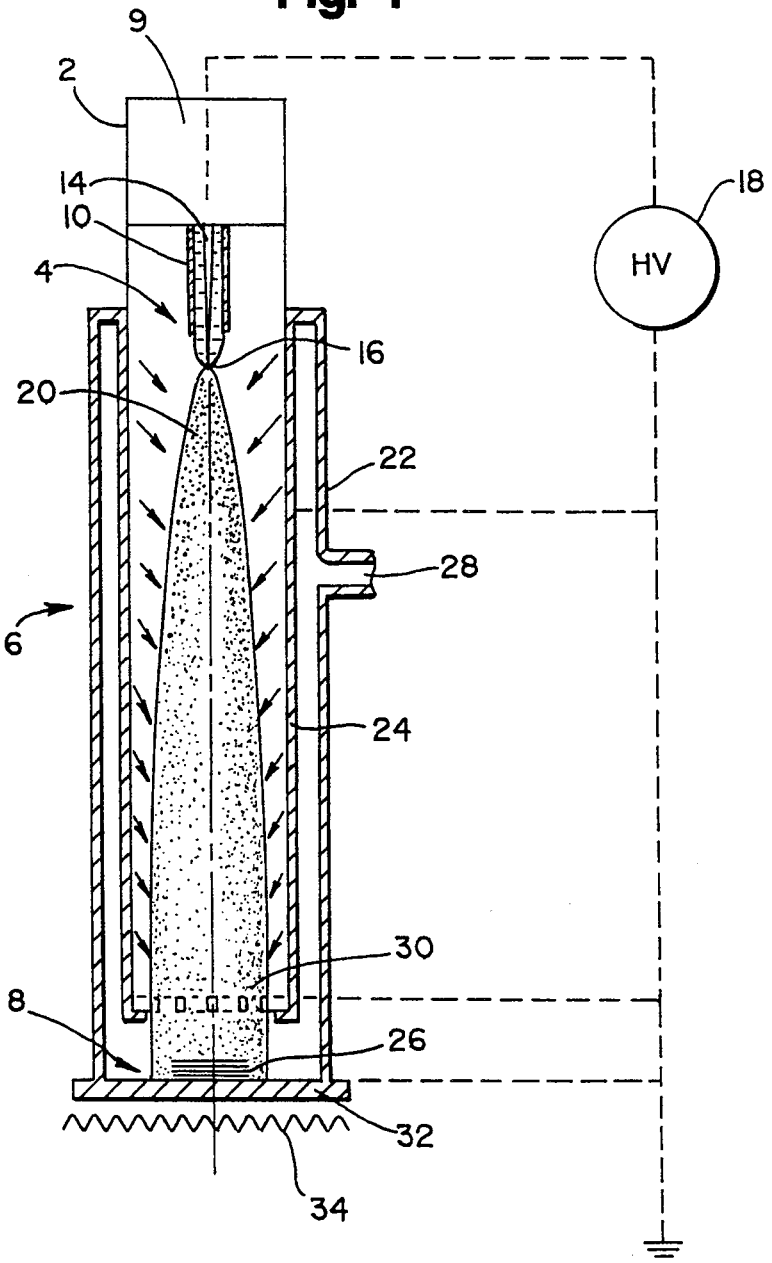
FIG. 1 is a schematic diagram of one form of apparatus in accordance with the invention.

As shown in the drawings, apparatus in accordance with the invention generally includes a supply vessel 2 for holding the working material or precursor, a spray unit 4 for transforming the working material into a spray of charged nanodrops, also referred to herein as a charged liquid cluster, a cluster processing unit 6 and a target or collection unit 8.

A working material or precursor 9 is first prepared by dissolving a base compound in a suitable solvent. The identity of the base compound is determined by the product which it is desired to produce either in the form of a thin film or nanoparticles. The solvent is determined by the properties of the base compound. When the desired product includes a number of base compounds or is the result of a chemical interaction of two or more base compounds, a plurality of precursor liquids are prepared, each being a solution of a base compound in an appropriate solvent. These precursor liquids are then mixed in the desired proportions depending on the desired product to produce a single precursor liquid which is placed in the supply vessel 2.

The solvent or solvents are selected according to the following criteria: capability to mix with other solvents, capability to dissolve the base compound or base compounds, and electrical and chemical properties in relation to the conditions in the spray unit 4 and the cluster processing unit 6.

Table 1 sets forth examples of various working materials used to produce various products.

TABLE 1

| Example | Solution Concentration In Moles | Solute | Solvent | Product | Nature of Product |
|---|---|---|---|---|---|
| 1 | 0.1 M | Zn-trifluoroacetate | Methanol | ZnO | piezoeletric, semiconductor thin films |
| 2 | 0.1 M | Y-trifluoroacetate | | | superconductor thin |
| | 0.2 M | Ba-trifluoroacetate | Methanol | $YBa_2Cu_3O_7$ | films |
| | 0.3 M | Cu-trifluoroacetate | | | |
| 3 | 0.1 M | Pd-trifluoroacetate | Water | Pd | metallic nanoparticles |
| 4 | 0.1 M | Ta-ethoxide | Methanol | $Ta_2O_5$ | insulator, thin films and nanoparticles |
| 5 | 0.1 M | Ag-trifluoroacetate | Methanol | Ag | metallic nanoparticles |
| 6 | 0.1 M | Pd-trifluoroacetate | Methanol | $Pd_{0.5}Ag_{0.5}$ | inter-metallic |
| | 0.1 M | Ag-trifluoroacetate | Methanol | | nanoparticles |

From these examples it may be seen that the method and apparatus are useful to produce a great variety of films and nanoparticles.

As illustrated, the apparatus is oriented vertically with the supply vessel 2 above the spray unit 4, which is located above the cluster processing unit 6, which is located above the target or collection unit 8, in order to eliminate differential gravitational effects on the process and provide a smooth liquid flow to the spray unit.

The supply vessel may have different characteristics in different applications. FIG. 1 shows the simplest form where the precursor is only required to be at room temperature and pressure and the vessel has no special characteristics except for nonreactivity with the precursor. Glass is a suitable material in most instances. Variations thereof will be described below in connection with the descriptions of FIGS. 3–5.

Figure 2:
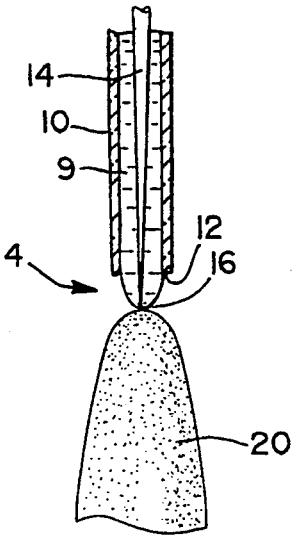
FIG. 2 is an enlarged schematic diagram of a spray unit forming part of the apparatus of FIG. 1.

As shown in FIGS. 1 and 2, the supply vessel 2 communicates at its lower end with a capillary tube 10 which extends downwardly therefrom and preferably is of the same material as the vessel for ease of fabrication. The capillary tube has an open lower end 12, so that the precursor liquid flows into the tube. Within the tube is a solid conductive needle electrode 14 with a sharp point 16 which extends beyond the lower end 12 of the tube 10. The interior diameter of the tube, the diameter of the needle electrode, the radius at the needle point and the distance beyond the end of the tube which the needle point extends are all selected so that at least when the needle is electrically neutral the surface tension of the precursor liquid prevents flow of the liquid out of the lower end 12 of the tube, except for a small amount which forms a hemispherical surface surrounding the point of the needle. In the preferred embodiment, the needle is made of tungsten, and the needle point is fabricated by electrochemical etching such that the diameter is less than a few microns.

In operation, the needle 14 is connected to a source 18 of direct current high voltage. This causes charge to be continuously injected into the liquid precursor, particularly in the small volume of liquid surrounding the needle point. The mechanism is either field emission if the polarity of the needle is negative or field ionization if the polarity is positive.

An important feature of the present invention is that the power, that is, the product of the voltage times the current, added to the charged liquid of a small volume is so great that when the surface tension of the liquid is overcome by electrical forces, the charged liquid at the surface is explosively ejected into a plurality of small jets which break up into nanoparticles, that is charged liquid clusters 20. This is in contrast to the earlier work by co-inventor Kim and others in which a single liquid jet was produced which broke up into drops which were larger than several microns.

Thus the dimensions of the tube, needle and needle extension are subject to further selection based on the voltage and current applied to the needle.

For the precursor liquids in Table 1, suitable dimensions are:

Tube interior diameter: 300–400 microns or larger

Needle diameter: less than half the size of the tube interior diameter at upper end to approximately five microns at point Needle point diameter: less than approximately five microns Needle extension beyond tube end: 200–300 microns Voltage: 10–20 kV Current: approximately greater than or equal to $10^{-9}$ amperes With greater voltages the needle point diameter may be greater.

FIG. 1 particularly illustrates the use of the nanodrops or charged liquid clusters to create uniform or patterned thin film deposits on a substrate. Cluster processing unit 6 as there illustrated includes a chamber 22 with electrodes 24 connected to power source 18 providing an electrical field in the chamber which accelerates and focuses or evenly disperses the nanodrops in their flight toward target unit 8 and particularly substrate 26. Magnets (not shown) and magnetic fields could also be used for this purpose. A port 28 for the entry of an inert carrier gas or a reactive gas into chamber 22, as desired, is provided. A patterned mask with holes therethrough 30 is positioned adjacent substrate 26. Depending on the desired applications, the mask may be permanent, removable or replaceable. An adjustable voltage applied to the mask focuses the charged liquid particles and enables the mask pattern to be reduced in scale when the nanoparticles are deposited on the substrate.

The target unit 8 includes a support member 32 which may be rotatable for uniform deposition or may be fixed and which may be heated by a heater 34 to promote any desired reaction of the nanodrops and substrate.

The extremely small size of the nanodrops provides new and improved advantages in even dispersion upon deposit on the substrate, deposition of even thinner films than are possible with micron size drops and greater reduction in scale of deposited patterns.

Figure 3:
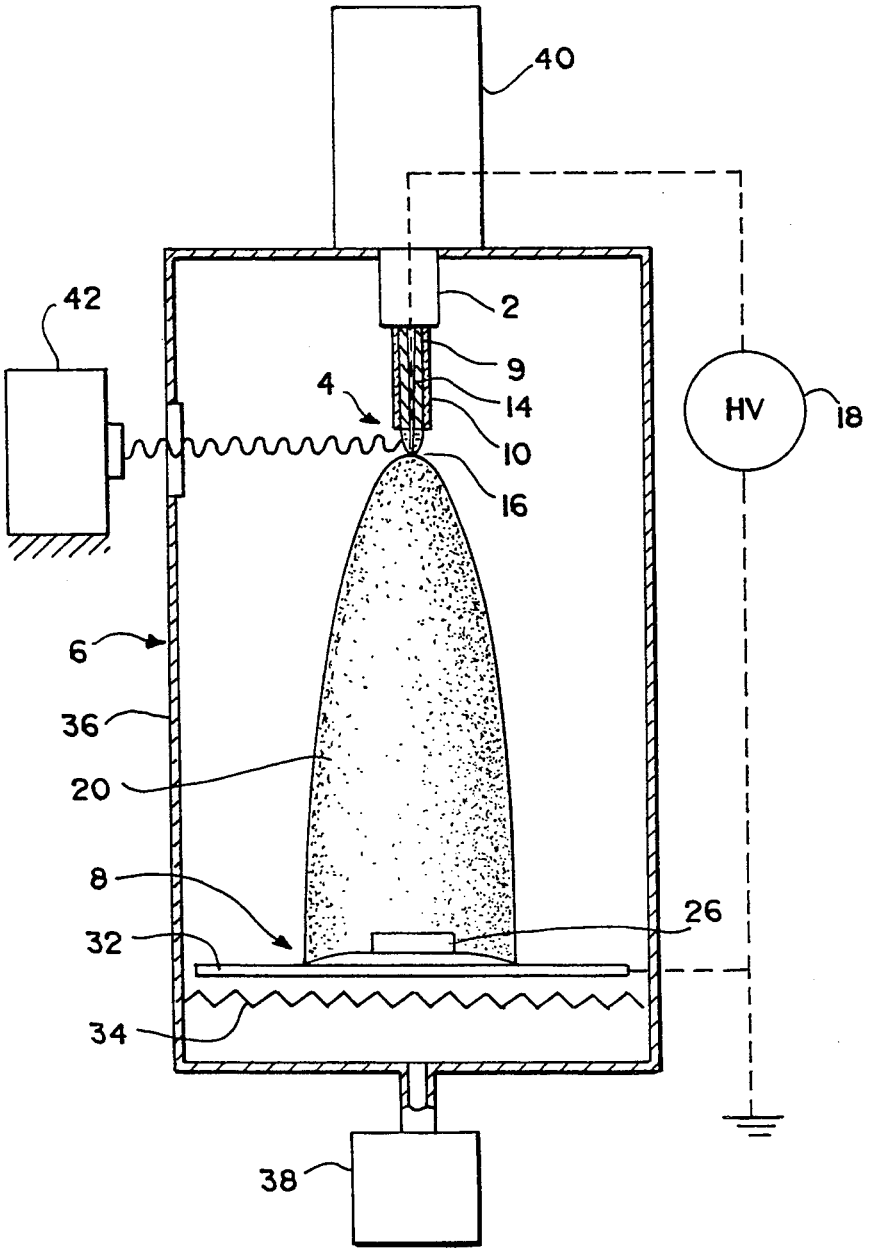
FIG. 3 is a schematic diagram of another form of apparatus in accordance with the invention.
Figure 4:
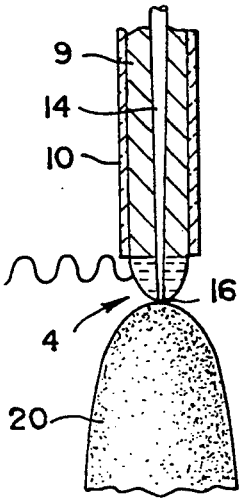
FIG. 4 is an enlarged schematic diagram of a spray unit forming part of the apparatus of FIG. 3.

FIGS. 3 and 4 illustrate a somewhat different apparatus and application. Some parts which are similar to those in FIGS. 1 and 2 are omitted from these drawings for clarity. In these Figures, the entire apparatus is enclosed in a gas tight chamber 36 connected to a gas pump 38. This enables the process to be performed in vacuum or at pressure which is lower or higher than ambient pressure, as desired. Also shown in these Figures is a cooling unit 40 which enables the liquid precursor 9 to be frozen in the supply vessel 2 and capillary tube 10. A heat source 42 such as a laser may be positioned to direct energy to the frozen liquid precursor surrounding the point 16 of needle 14 thereby changing this small volume of precursor to liquid form. By minimizing the volume of precursor in liquid form, the required power to be transferred from the needle point may be minimized and the process made more effective and efficient. The pressure control and frozen precursor variations may be used separately or together, as desired or dictated by material parameters.

In FIGS. 3 and 4 the target unit is shown including heater 34, substrate support 32 and substrate 26. Structures shown in FIGS. 1 and 2, which could also be included but are not shown, for clarity, are pattern mask 30, gas port 28 and particle control electrodes 24.

Figure 5:
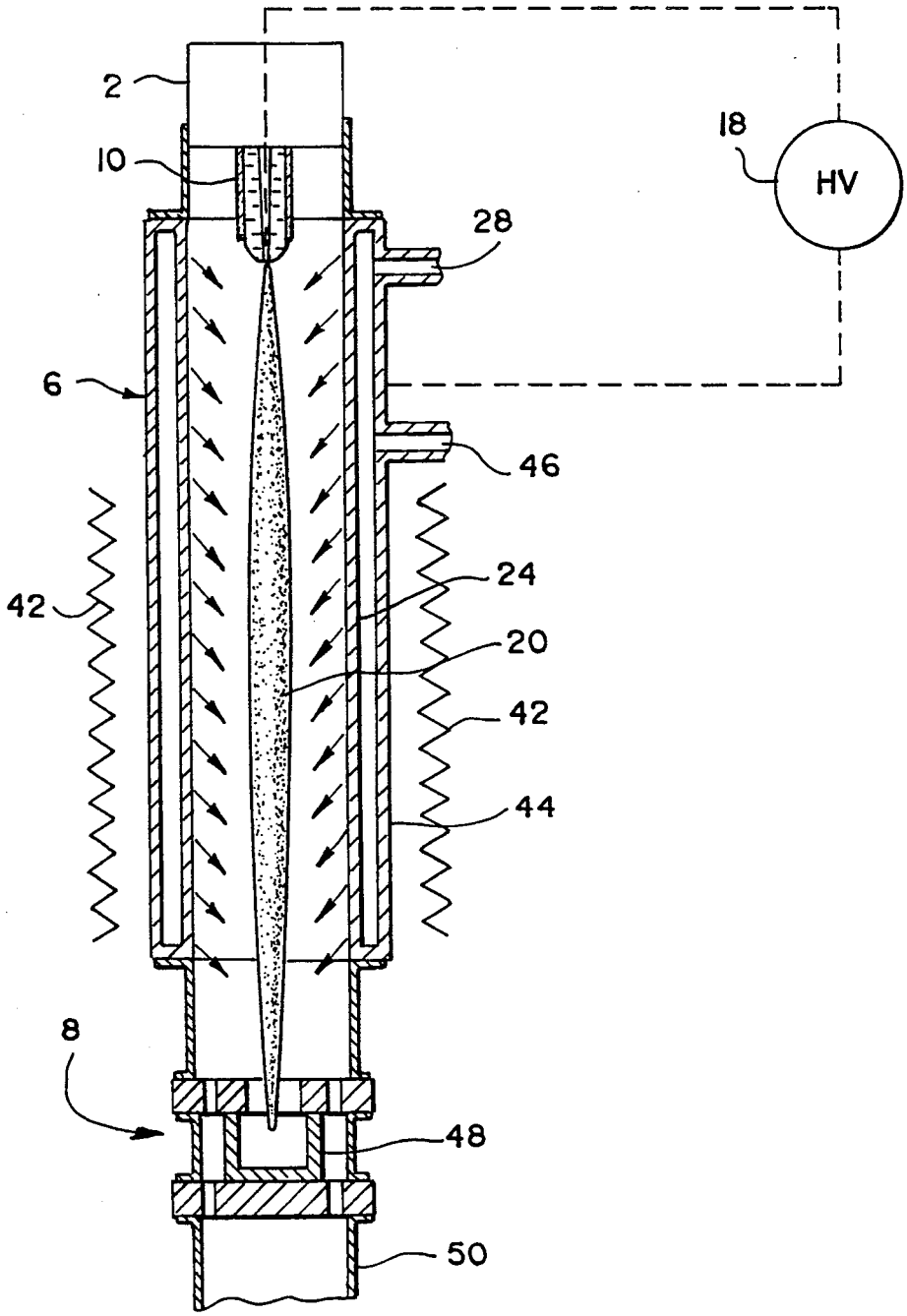
FIG. 5 is a schematic diagram of still another form of apparatus in accordance with the invention.

In FIG. 5 a liquid precursor is again placed in supply vessel 2 and capillary tube 10 to produce nanodrops. Electrodes 24 or, alternatively, magnets are used to separate nanodrops of the desired size to produce nanoparticles. The beam processing unit 6 includes reaction chamber 44, heater 42 and port 46 for the introduction of a reactant gas which reacts with the nanodrops or facilitates decomposition to produce nanoparticles which are collected in a collection vessel 48. Also provided is suction pump 50 to remove excess gases and port 28 for any desired carrier gas.

Table 2 sets forth examples of the production of nanoparticles. Percentages are by volume.

TABLE 2

| Example | Solute | Vol % | Solvent | Vol % | Reactant Gas | Product |
|---|---|---|---|---|---|---|
| 1 | Silicon Tetraethoxide | 10 | Ethanol | 90 | $O_2$ | $SiO_2$ |
| 2 | Tantalum Ethoxide | 20 | Methanol | 80 | $O_2$ | $Ta_2O_5$ |
| 3 | Barium Titanium | 10 | Methanol | 90 | $O_2$ | $BaTiO_3$ |

TABLE 2-continued

| Example | Solute | Vol % | Solvent | Vol % | Reactant Gas | Product |
|---|---|---|---|---|---|---|
| | Alkoxide | | | | | |

For metallic nanoparticle formation, $N_2$ or an inert gas would be preferred over $O_2$. The solvent is desirably methanol or another inorganic compound which will readily decompose and solidify under heat.

Various changes, modifications and permutations of the described method and apparatus will be apparent to those skilled in the art without departing from the invention as set forth in the appended claims.

What is claimed is:

1. Apparatus for producing nanodrops comprising a. a supply vessel for receiving a liquid precursor, b. a hollow tube communicating at one end thereof with said supply vessel for receiving said liquid precursor therefrom and open at the other end thereof, c. a solid electrically conductive needle electrode positioned within said tube and having a point extending out of said open end of said tube, d. said tube and said needle point having dimensions such that surface tension of said liquid precursor prevents flow of said liquid precursor from said open end of said tube, and e. electrical power means for applying a direct current voltage to said needle whereby charges are injected into said liquid precursor adjacent to said point of said needle causing said surface tension of said liquid precursor to be overcome by the mutually repulsive forces of said injected charges to produce a plurality of charged liquid jets which break up into nanodrops.

2. Apparatus according to claim 1 including a target and means for directing said nanodrops to said target.

3. Apparatus according to claim 2, wherein said target includes a flat substrate whereby said nanodrops directed thereto form a film thereon.

4. Apparatus according to claim 2 including means for introducing at least one gas among said nanodrops between said tube and said target.

5. Apparatus according to claim 4 including means for introducing at least two gases among said nanodrops between said tube and said target.

6. Apparatus according to claim 3 including a mask between said tube and said target for directing said nanodrops into a pattern on said substrate.

7. Apparatus according to claim 1 including means for freezing at least a portion of said liquid precursor adjacent said open end of said tube.

8. Apparatus according to claim 7 including means for thawing at least a portion of said frozen liquid precursor.

9. Apparatus according to claim 1 including means for adjusting pressure surrounding said nanodrops between said tube and said target.

10. Apparatus according to claim 4 including means between said tube and said target for removal of said gas from said apparatus.

11. Apparatus according to claim 4 including means for converting said nanodrops into nanoparticles by introducing a reactive gas among said nanodrops between said tube and said target and wherein said target comprises a collection container for nanoparticles.

12. A method for producing nanodrops comprising a. dissolving at least one base compound in a solvent to produce a liquid precursor, b. positioning within a hollow tube having an open end and a liquid precursor receiving end a solid electrically conductive needle electrode having a point extending out of said open end, said tube and said needle point having dimensions such that surface tension of said liquid precursor prevents flow of said liquid precursor from said open end, c. feeding said liquid precursor into said liquid precursor receiving end, and d. injecting mutually repulsive charges into said liquid precursor adjacent said open end such that mutually repulsive forces of said charges overcome said surface tension of said liquid precursor to produce a plurality of charged liquid jets which break up into nanodrops.

13. A method in accordance with claim 12, further comprising freezing said liquid precursor and thawing a portion thereof.

14. A method for producing nanodrops comprising a. dissolving at least one base compound in a solvent to produce a liquid precursor, b. positioning within a hollow tube having an open end and a liquid precursor receiving end a solid electrically conductive needle electrode having a point extending out of said open end, said tube and said needle point having dimension such that surface tension of said liquid precursor prevents flow of said liquid precursor from said open end, c. feeding said liquid precursor into said liquid precursor receiving end, d. injecting mutually repulsive charges into said liquid precursor adjacent said open end such that mutually repulsive forces of said charges overcome said surface tension of said liquid precursor to produce a plurality of charged liquid jets which break up into nanodrops, and e. directing said nanodrops to a target.

15. A method in accordance with claim 14, wherein the breaking up into nanodrops takes place in an atmosphere having a controlled pressure.

16. A method in accordance with claim 14 comprising reacting said nanodrops with a gas to produce nanoparticles.

17. A method in accordance with claim 14 comprising decomposing said nanodrops to produce nanoparticles.

18. A method in accordance with claim 14 comprising directing said nanodrops through a patterned mask to said target.

* * * * *

UNITED STATES PATENT AND TRADEMARK OFFICE

CERTIFICATE OF CORRECTION

PATENT NO. : 5,344,676
DATED : September 6, 1994
INVENTOR(S) : Kyekyoon Kim and Chon K. Ryu It is certified that error appears in the above-indentified patent and that said Letters Patent is hereby corrected as shown below:

In Column 6, line 37 change "dimension" to -- dimensions --.

Signed and Sealed this

Eighth Day of November, 1994

*Attest:*

*Attesting Officer*

BRUCE LEHMAN

*Commissioner of Patents and Trademarks*